US008752497B2

(12) United States Patent
Crippa

(10) Patent No.: US 8,752,497 B2
(45) Date of Patent: Jun. 17, 2014

(54) ANCHOR DEVICE

(75) Inventor: Giovanni Crippa, Rapallo (IT)

(73) Assignee: Maria Prestipino, Rapallo (GE) (IT)

( * ) Notice: Subject to any disclaimer, the term of this patent is extended or adjusted under 35 U.S.C. 154(b) by 138 days.

(21) Appl. No.: 13/428,000

(22) Filed: Mar. 23, 2012

(65) Prior Publication Data

US 2012/0272887 A1 Nov. 1, 2012

(30) Foreign Application Priority Data

Mar. 23, 2011 (IT) ..... PD2011A000089

(51) Int. Cl.
*B63B 21/46* (2006.01)

(52) U.S. Cl.
USPC ..... 114/297; 114/299

(58) Field of Classification Search
USPC ..... 114/297, 299
IPC ..... B63B 21/46
See application file for complete search history.

(56) References Cited

U.S. PATENT DOCUMENTS 2,643,629 A * 6/1953 Huck ..... 114/297
4,987,847 A * 1/1991 Kobayashi ..... 114/297

FOREIGN PATENT DOCUMENTS

DE 19635688 C1 4/1998
EP 0297703 A1 1/1989
GB 2325448 A 11/1998
GB 2336142 A 10/1999

OTHER PUBLICATIONS

Search Report issued in corresponding Italian patent application PD2011A000089 dated Nov. 10, 2011.

* cited by examiner

*Primary Examiner* — Stephen Avila
(74) *Attorney, Agent, or Firm* — Kristina Castellano; Castellano PLLC

(57) ABSTRACT

An anchor device includes a connecting member between an anchor and its anchor line, having a first part designed to be fastened to one end of the shank of the anchor and a second part extending axially and designed to be fastened releasably to the first part and to be connected to the anchor line; including a piston which is slidable in a cavity of the second part; and a body designed to be moved by sliding along the anchor line until it interacts with the piston, thus releasing the first part and second part.

11 Claims, 7 Drawing Sheets

ANCHOR DEVICE

CLAIM FOR PRIORITY

This application claims the benefit of priority to Italian patent application PD2011A000089 filed Mar. 23, 2011, the entire contents of which are incorporated herein by reference.

FIELD

The present invention relates to an anchor device of the type described herein.

BACKGROUND

U.S. Pat. No. 6,209,475 describes an anchor device wherein the connecting member between the anchor and its anchor line can be opened by interaction between one or more pistons, movable radially on the connecting member, and a bell-shaped body which can be lowered along the anchor line in order to interact with these pistons.

The pressure exerted as a result of the insertion of the bell into the connecting member causes the release of the latter and the consequent disconnection of the anchor line from the ring of the anchor. However, a connection is maintained by means of a retrieval line which connects the connecting member to the crown of the anchor.

This solution enables the anchor to be retrieved in case of fouling, and, if the retrieval line is weaker than the anchor line, it enables at least the latter to be retrieved as a result of the breaking of the retrieval line if it proves impossible to free the anchor. However, this solution has two main drawbacks. The first is that the piston causing the connecting member to open is movable radially with respect to the axis of the member, and therefore the piston moves orthogonally to the direction of sliding of the bell used for the opening operation. Because of the hydrostatic pressure acting on the bell, the opening operation may be difficult in the presence of grains of mud or sand which impede the movement of the piston. Secondly, the device is subject to potential accidental opening of the connecting member between the anchor and the anchor line, due to interference between the connecting member and rocks on the sea bed. In practice, there is no protection for the piston which causes the connecting member to be released. Furthermore, the device, at least in the solution shown in FIGS. 9 and 10 of U.S. Pat. No. 6,209,475, is resiliently stressed towards an open condition the connecting member, which is somewhat hazardous because of the aforementioned risk of accidental release.

U.S. Pat. No. 2,669,962 describes an anchor device whose release, when the anchor has become fouled, is dependent on a sudden pull on the anchor line. Since sudden pulls may also occur as a result of powerful atmospheric disturbances, the system is insufficiently reliable.

There are also known anchor devices which include a retrieval line associated with a sleeve which is slidable on the anchor line and which can be hooked from above, if the anchor becomes fouled, so that a pull can be exerted on the retrieval line. These devices (see, for example, www.anchor-rescue.com) have the drawback that, if the anchor becomes fouled, it is recovered purely by using the line associated with the retrieval line, rather than by using the anchor line. In critical conditions, as in the case of a squall, the pull exerted in this way may be excessive. Furthermore, if the release operation is unsuccessful, there is a risk that the anchor line may be lost as well as the anchor.

SUMMARY

The problem on which the invention is based is that of providing an anchor device whose structural and functional design such that the drawbacks of the aforementioned art can be overcome.

This problem is resolved by the invention by means of an anchor device as described herein.

BRIEF DESCRIPTION OF THE DRAWINGS

The features and advantages of the invention will be made clearer by the following detailed description of preferred, but non-exclusive, exemplary embodiments of the invention, illustrated, for the purposes of guidance and without restrictive intent, with reference to the attached drawings, in which.

DETAILED DESCRIPTION

Figure 1:
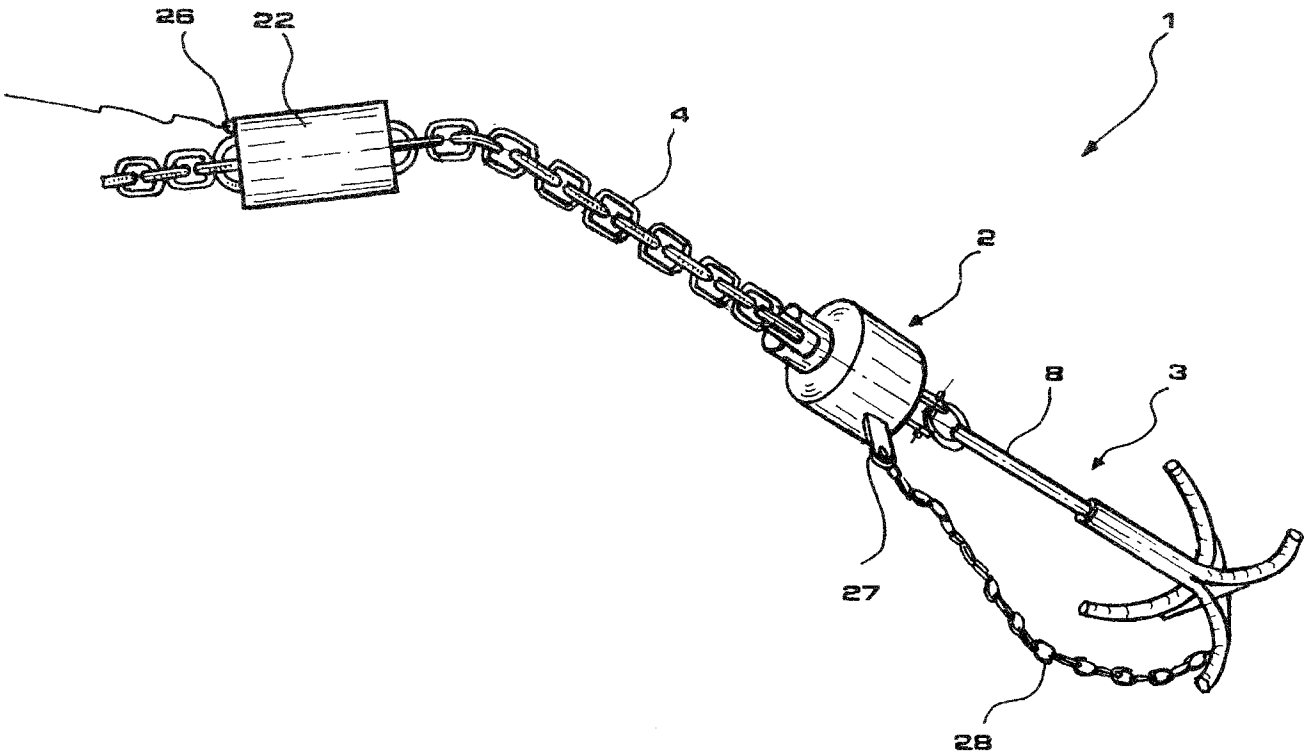
FIG. 1 is a schematic view of an anchor device according to non-limiting embodiments of the present invention.

The aspects, advantages and/or other features of example embodiments of the present disclosure will become apparent in view of the following detailed description, taken in conjunction with the accompanying drawings.

In describing example embodiments, specific terminology is employed for the sake of clarity. However, the example embodiments are not intended to be limited to this specific terminology. Unless otherwise noted, technical terms are used according to conventional usage. All patents and publications mentioned in this specification are indicative of the level of those skilled in the art to which the invention pertains. All publications, patent applications, patents, and other references mentioned herein are incorporated by reference in their entirety.

As used herein, "a" or "an" may mean one or more. As used herein, "another" may mean at least a second or more. Furthermore, unless otherwise required by context, singular terms include pluralities and plural terms include the singular.

In the drawings, the number 1 indicates the whole of an anchor device comprising a connecting member 2 between an anchor 3 and its anchor line 4.

The anchor line 4 can include a chain, or a braided cable, or both.

The connecting member 2 comprises a first part 6 provided with a fork 7 for fixing by means of a pin 7*a* to one end (the ring) of the shank 8 of the anchor 3. It also comprises a second part 9 designed to be fastened releasably to the first part 6, on the one hand, and to be connected permanently, by means of a second fork 10 and a corresponding pin 10*a*, to the anchor line 4, on the other hand. The two parts of the connecting member 2 are generally cylindrical in shape and are coaxial when coupled together.

Figure 2:
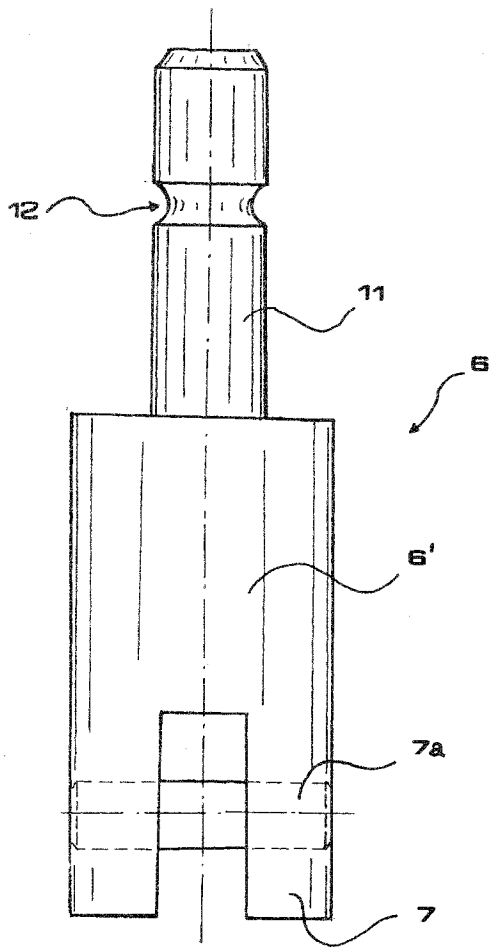
FIG. 2 is a side view of a first part of the device of FIG. 1.

The first part 6 has a cylindrical appendage 11 extending from the end opposite the fork 7 and having a semi-toroidal channel 12. Additionally, as shown in FIG. 2, the first part 6 is composed of a further cylindrical body 6', at one end of which the fork 7 is formed. In an alternative embodiment, not shown in the drawings, the cylindrical appendage 11 can be made to be axially offset with respect to the cylindrical body 6', so as to facilitate the rotation of the anchor on the stem head.

Figure 3:
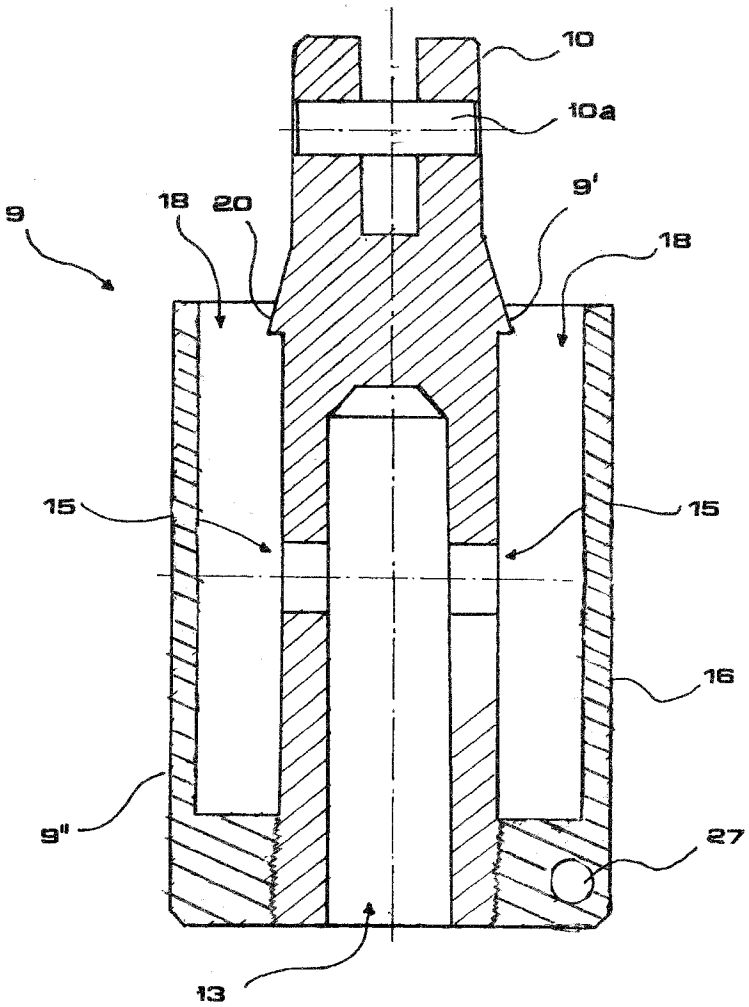
FIG. 3 is a sectional side view of a second part of the device of FIG. 1.

With reference to FIG. 3, the second part 9 is shaped in the form of a sleeve, with an axial blind hole 13 into which the appendage 11 can be fitted. This part can also be composed of two bodies 9' and 9", the first body 9' forming the aforesaid sleeve, while the second body 9" is in the shape of a hollow cylinder extending outside the sleeve so as to form a shell 16 and delimit an annular cavity 18 between the two bodies. This configuration enables the second part 9 to be made more simply, with the bodies 9' and 9" joined by a threaded connection.

Figure 5:
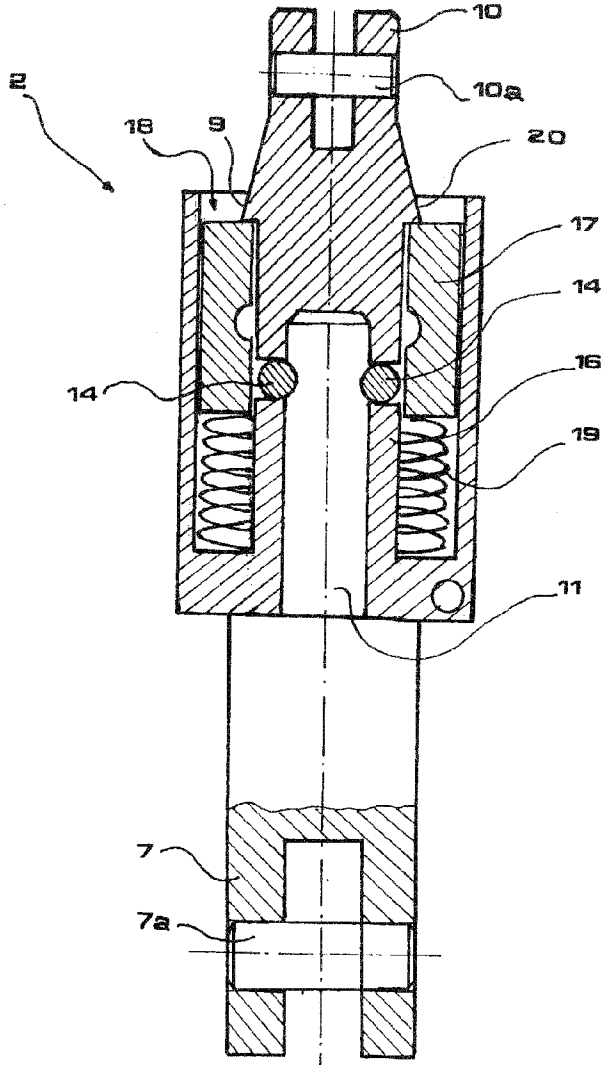
FIG. 5 is a sectional side view of the device of FIG. 1.
Figure 4:
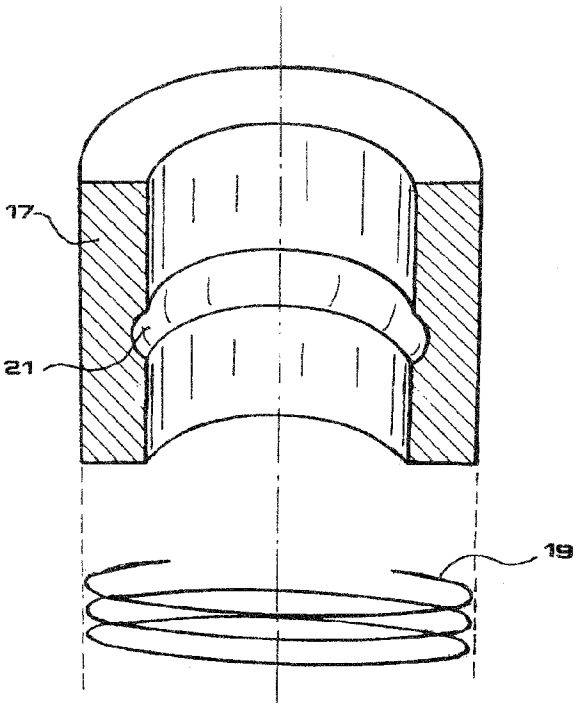
FIG. 4 is a perspective view, in section, of a piston and of a corresponding spring, which are details of the device of FIG. 2.
Figure 6B:
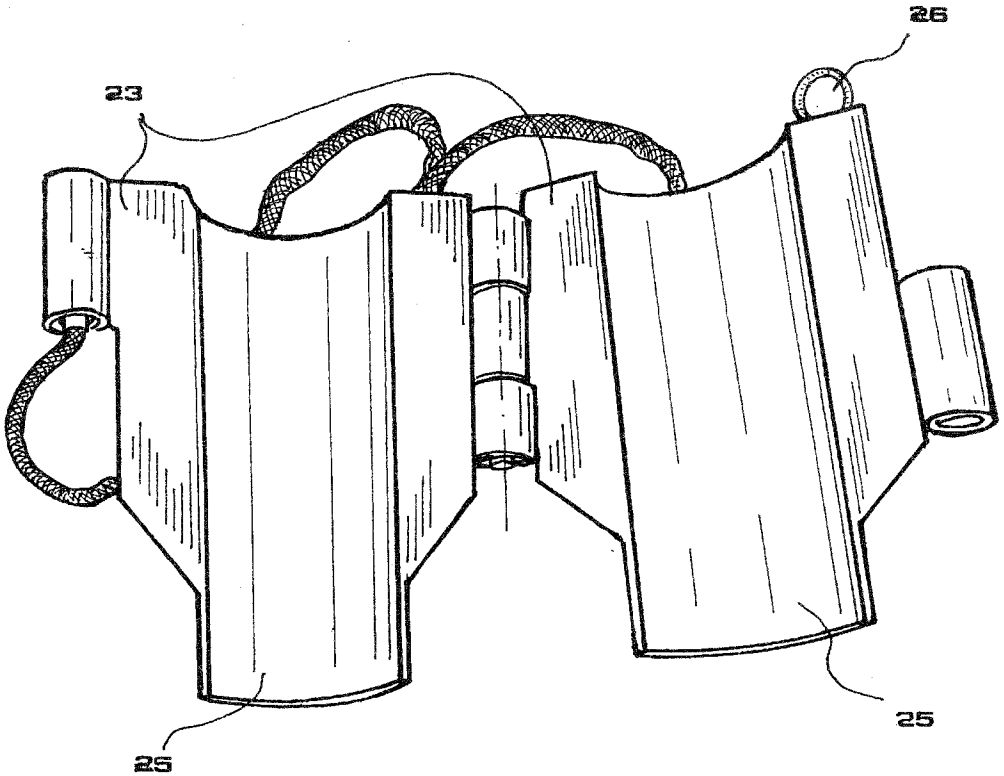
FIGS. 6A and 6B are a perspective view and a side view, in two respective operating configurations, of a slidable body which is a detail of FIG. 1.
Figure 6A:
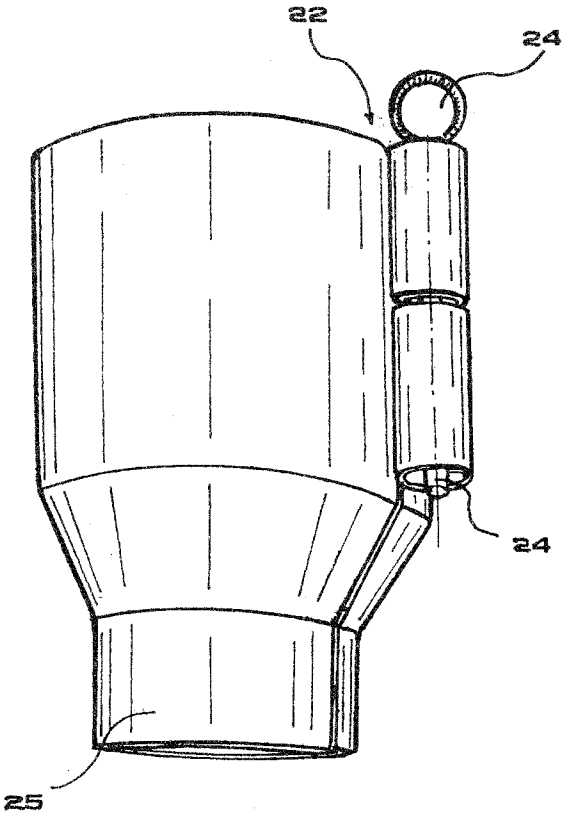
Figure 7:
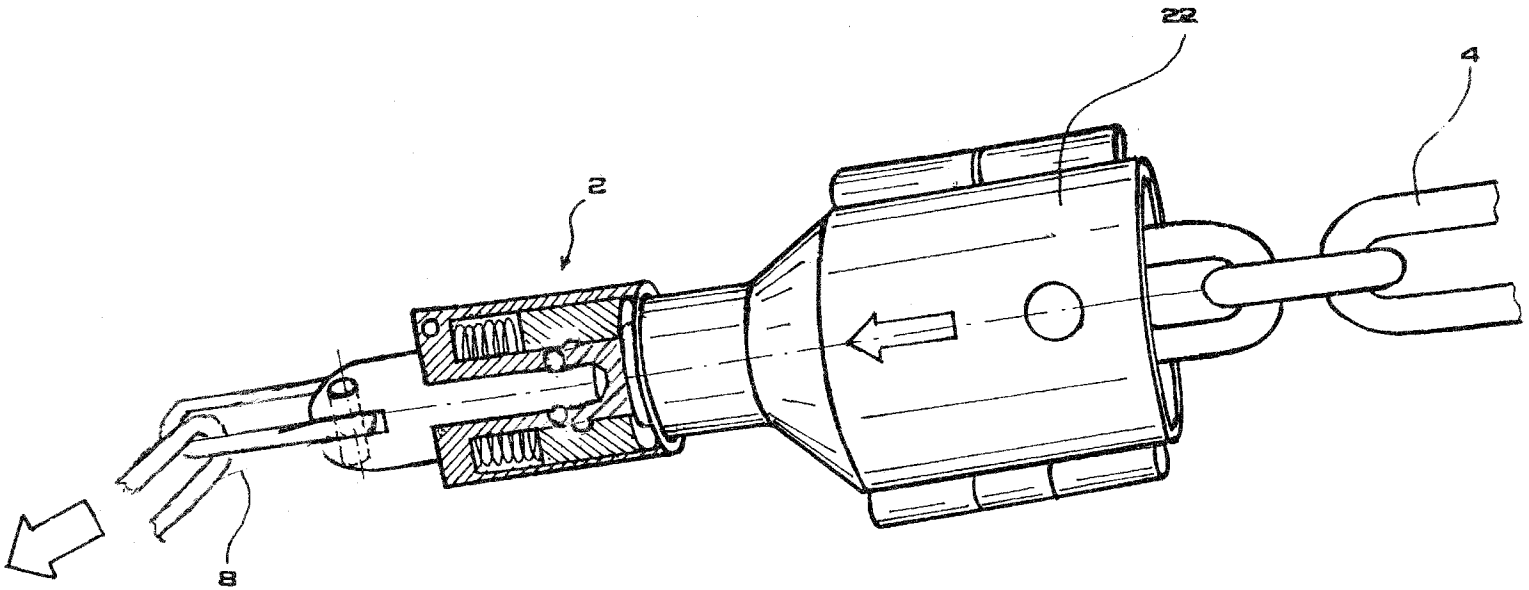
FIG. 7 is a perspective view which schematically illustrates the operation of the device according to the present invention.

With reference to FIG. 5, balls 14 are held so as to be radially movable in a corresponding set of radial holes 15 formed in the sleevelike body 9' of the second part 9, these holes being positioned next to the channel 12 when the first part 6 and the second part 9 are coupled together, the balls serving to retain the cylindrical appendage 11 in the hole 13 by removably engaging the channel 12. The balls 14 are kept in engagement with the channel 12 by an annular piston 17 slidably guided in the annular cavity 18 of the second part 9 in a direction coaxial with the part 9 and substantially in prolongation of the anchor line 4, for the reasons explained below.

A spring 19 keeps the piston 17 resiliently stressed towards a stop 20 so as to limit the movement of the piston within the cavity 18. It should be noted that the shell 16 extends axially beyond the stop 20, thereby protecting the piston 17 throughout its axial stroke. The outward-facing end of the piston 17 cannot pass beyond the end of the shell 16, since the stroke of the piston is limited by the stop 20. In the annular inner surface of the piston 17 there is formed a semi-toroidal channel 21 such that, when the piston 17 is made to slide in the cavity 18 in opposition to the spring 19 until the channel 21 is placed next to the balls 14, the balls can disengage from the channel 12, thereby releasing the first part of the member 2. The annular piston 17 is actuated by means of a body 22 formed by two semi-cylinders 23 hinged so as to be openable for fitting the body on to the anchor line 4 and reclosable on the line, by means of a pin closure 24, for example. The body 22 terminates, on its end facing the connecting member 2, in a cylindrical appendage 25 which projects axially to interact with the piston 17 by pushing it in opposition to the spring 19. The body has an eye 26 to which a cable is tied to control its descent along the mooring line towards the anchor.

A second eye 27 is formed in the second part 9 of the member 2 for connection to an end of the retrieval line 28, the opposite end of which is connected to the crown of the anchor, or to the end of the shank opposite the ring.

Because the body is able to interact axially with the piston 17, the effect of the impact of the body on the piston is maximized, giving rise to a relatively high force which is sufficient to open the member 2. It is also possible to use locking means and counter-means which oppose the opening more strongly, thus improving the protection of the device against accidental opening, while using the same body 22.

When the first part of the member 2 has been released from the first, and the anchor line is pulled, the anchor will be raised from the sea bed by the crown part, instead of by the ring, and it will easily be released. If the release operation is unsuccessful, then if the arrangement is such that a retrieval line weaker than the anchor line is used, a sufficient pull can be exerted to break the retrieval line, thereby releasing the anchor line from the fouled anchor so that the anchor line, at least, can be recovered.

Figure 8:
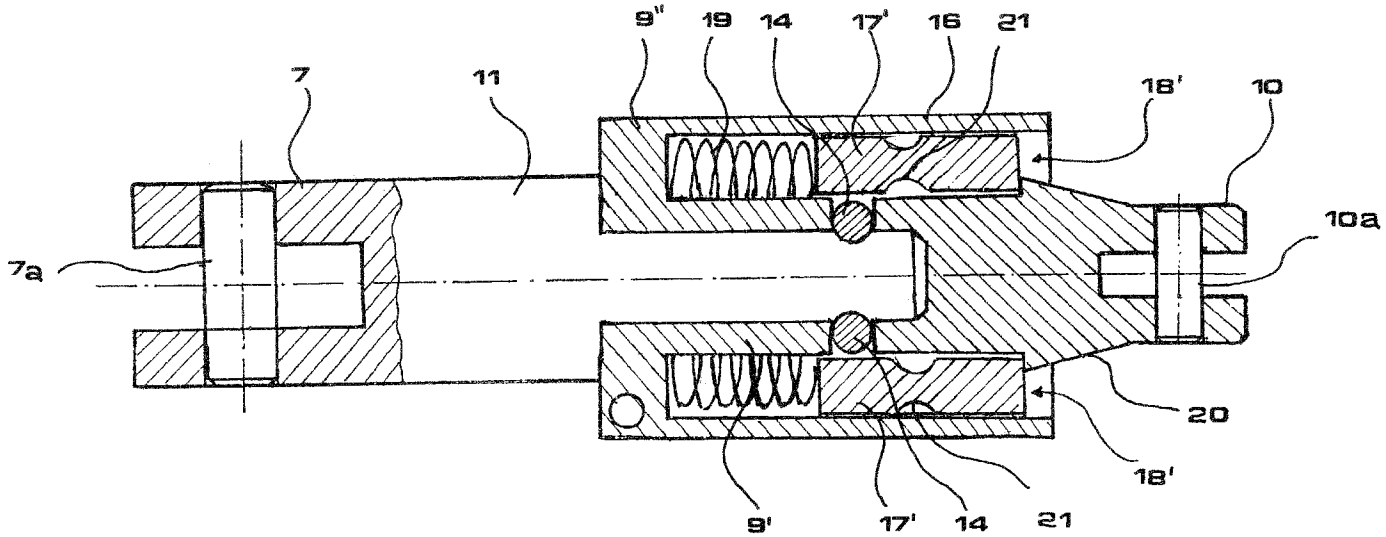
FIG. 8 is a sectional side view of a second embodiment of the device according to non-limiting embodiments of the present invention.

A second embodiment of the invention is shown in FIG. 8, wherein similar details are identified by the same reference numerals as in the preceding figures.

This solution differs from the preceding one in that the piston is formed by at least a pair of pistons 17', located in diametrically opposite positions, each of which is associated with a respective spring 14.

The second part 9 therefore has a pair of holes 18', in which the pistons and the springs can be housed. In greater detail, the pistons 17' also have a semi-toroidal channel 21', which can be coupled with the balls 14, as in the preceding embodiment.

This embodiment provides high robustness and precision of operation by comparison with the preceding embodiment.

Figure 9:
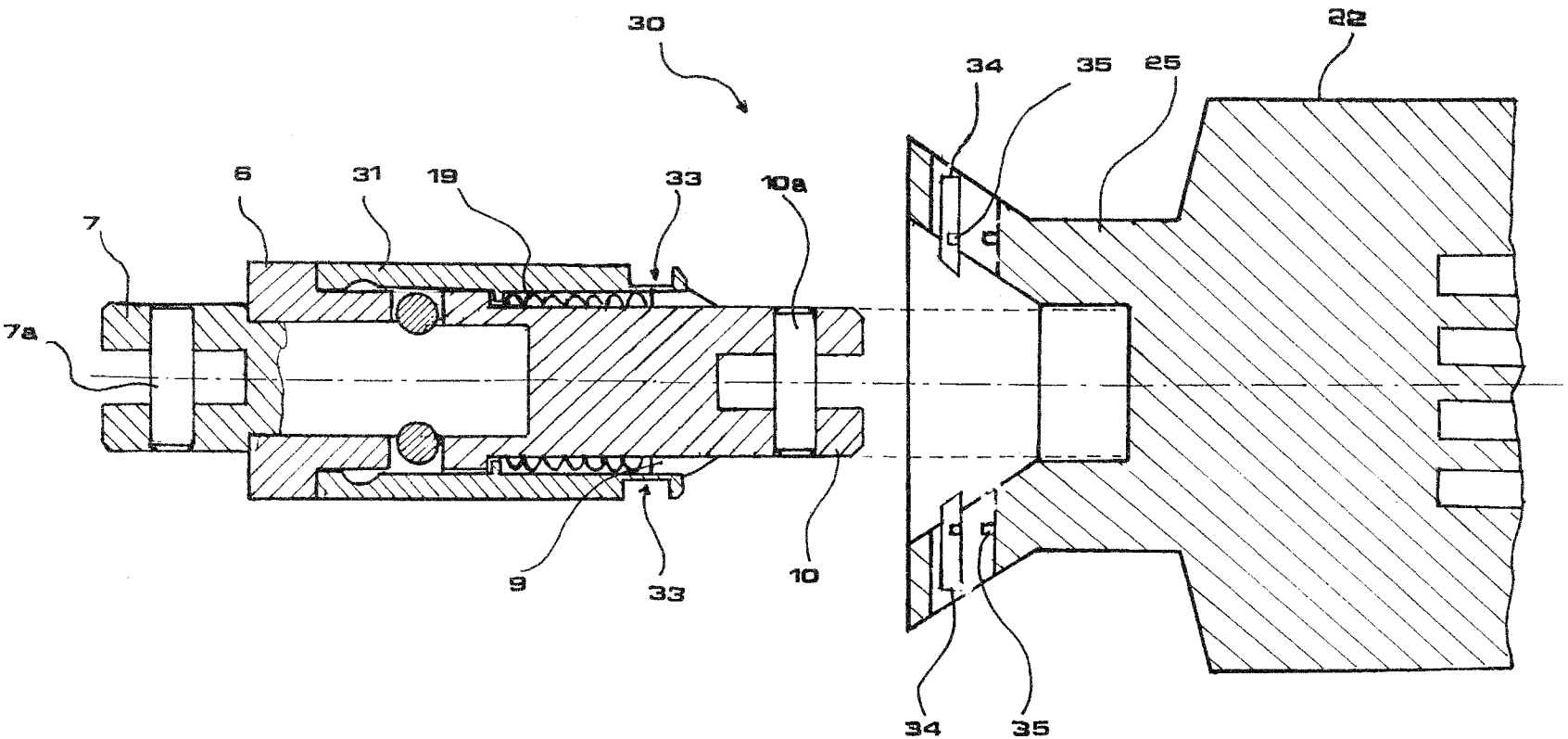
FIG. 9 is a sectional side view of a third embodiment of the device according to the present invention.

A third embodiment will now be described with reference to FIG. 9. In this solution, identified as a whole by the number 30, the piston 31 is mounted outside the second part 9 and is stressed by the spring 19 so that one of its ends bears on a flange 32. At the opposite end there is formed a channel 33 by means of which the piston is engaged by snap-fitting by a plurality of catches 34 located at the corresponding end of the body 22. In this case, the appendage 25 is flared to facilitate the snap-fitting engagement of the catches 34 in the channel 33 by means of a spring 35, shown schematically in the drawing. In this case, when the body 22 has been lowered along the anchor line until its catches 34 engage in the channel 33, the piston 31 is actuated to release the first part of the member 2 by pulling the body 22 away from the fouled anchor by means of a cable.

Although the invention has been described in example embodiments, those skilled in the art will appreciate that various modifications may be made without departing from the spirit and scope of the invention. It is therefore to be understood that the inventions herein may be practiced other than as specifically described. Accordingly, it is intended that such changes and modifications fall within the scope of the present invention as defined by the claims appended hereto. Thus, the present embodiments should be considered in all respects as exemplary and illustrative and not restrictive.

I claim:

1. An anchor device comprising:

a connecting member between an anchor and its anchor line, having a first part designed to be fastened to one end of a shank of the anchor and a second part extending axially and designed to be fastened releasably to the first part and to be connected to the anchor line;

releasable locking means and counter-means between the first and second parts;

the locking means and counter-means including an annular piston which is slidable in a cavity of the second part and which, by its movement relative to the second part in the cavity, causes the release of the locking means and counter-means; and a body designed to be removably applied onto the anchor line and dropped by sliding along the anchor line until it interacts with the annular piston, thus releasing the locking means and counter-means;

wherein the piston is slidable axially in the second part in a direction parallel to the direction of sliding of the body and is directly subject to the action of the body.

2. The anchor device according to claim 1, wherein the piston is surrounded circumferentially by a shell of the second part.

3. The anchor device according to claim 1, further comprising a retrieval line extending between the anchor and the second part of the connecting member for the release of the anchor in case of fouling.

4. The anchor device according to claim 3, wherein the retrieval line has a lower tensile breaking strength than the anchor line.

5. The anchor device according to claim 1, wherein the first part comprises a cylindrical body and a cylindrical appendage, the appendage being offset axially with respect to the body.

6. The anchor device according to claim 1, wherein the locking means and counter-means comprise balls housed movably in radial holes formed in a sleevelike body of the second part, the balls being selectively engageable in a channel of the first part, in a locked configuration of the device, or in a channel of the piston, in an unlocked configuration of the device.

7. The anchor device according to claim 6, wherein the first part comprises a cylindrical body and a cylindrical appendage, and wherein the channel of the first part is formed in the appendage.

8. The anchor device according to claim 1, wherein the piston is stressed resiliently by a spring towards a stop adapted to limit axial movement of the piston within the cavity.

9. The anchor device according to claim 1, wherein the cavity is formed by a shell outside the piston, the piston being slidable with respect to the shell.

10. The anchor device according to claim 9, wherein the piston is kept within the cavity throughout the stroke of the piston in a direction parallel to the direction of sliding of the body.

11. Anchoring device according to claim 1, wherein said body is formed by two semi-cylinders hinged to each other so as to be openable for fitting the body on to the anchor line and reclosable on the line.

* * * * *